US010905266B1

(12) United States Patent
Hsiao

(10) Patent No.: US 10,905,266 B1
(45) Date of Patent: Feb. 2, 2021

(54) PILLOW STRUCTURE

(71) Applicant: CHERN SHING TOP CO., LTD., Zhugi Township (TW)

(72) Inventor: Hsueh-Sheng Hsiao, Zhugi Township (TW)

(73) Assignee: Chern Shing Top Co., Ltd., Zhugi Township (TW)

( * ) Notice: Subject to any disclaimer, the term of this patent is extended or adjusted under 35 U.S.C. 154(b) by 0 days.

(21) Appl. No.: 16/828,028

(22) Filed: Mar. 24, 2020

(51) Int. Cl.
*A47G 9/10* (2006.01)

(52) U.S. Cl.
CPC ..... *A47G 9/10* (2013.01); *A47G 9/1009* (2013.01); *A47G 9/1081* (2013.01)

(58) Field of Classification Search
CPC .. A47G 9/10; A47G 2009/008; A47G 9/1009; A47G 9/1081
See application file for complete search history.

(56) References Cited

U.S. PATENT DOCUMENTS 588,957 A * 8/1897 Cowley ..... A47C 27/05 5/642
3,241,879 A * 3/1966 Castello ..... A47C 7/30 297/284.4
4,787,106 A * 11/1988 Paxon ..... A47G 9/10 5/648
4,941,478 A * 7/1990 Takeuchi ..... A61F 5/56 128/848
5,353,457 A * 10/1994 Chu ..... A47G 9/1009 5/640
7,987,537 B1 * 8/2011 Hsiao ..... A47G 9/1081 5/630
2010/0325803 A1 * 12/2010 Requena ..... A47G 9/1009 5/640
2011/0247140 A1 * 10/2011 Nakayama ..... A47G 9/1009 5/640
2020/0069087 A1 * 3/2020 Chang ..... F16H 25/186
2020/0180922 A1 * 6/2020 Huang ..... B66F 7/28

* cited by examiner

*Primary Examiner* — Eric J Kurilla
(74) *Attorney, Agent, or Firm* — Karin L. Williams; Mayer & Williams PC

(57) ABSTRACT

A pillow structure includes a pillow, a buffering layer mounted in the pillow, a base plate mounted on a bottom of the buffering layer and received in the pillow, and elastic cushions mounted on the base plate and drawn by adjusting devices. The elastic cushions are mounted on the bottom face of the base plate to support and adjust the height of the pillow, such that the pillow has an optimum height to provide a comfortable sensation to a user when sleeping at a supine position and sleeping sideways. The elastic cushions are also mounted on the top face of the base plate to push the buffering layer of the pillow so as to support the user's head and neck.

6 Claims, 7 Drawing Sheets

PILLOW STRUCTURE

BACKGROUND OF THE INVENTION

1. Field of the Invention

The present invention relates to a pillow structure.

2. Description of the Related Art

A conventional pillow structure comprises a pillowcase and a buffering layer mounted in the pillowcase. The buffering layer is made of silica gel to provide a comfortable sensation to the user. However, the conventional pillow structure has a fixed height that cannot be adjusted according to the user's requirement, such that the user easily feels uncomfortable when sleeping at different states, such as sleeping upwards, sleeping sideways or the like. In addition, when the user's head and neck are placed on the pillow structure, the pillow structure is compressed downward due to the user's gravity, such that the pillow structure cannot support the user's head and neck efficiently, thereby easily affecting the blood circulation of the user.

BRIEF SUMMARY OF THE INVENTION

The primary objective of the present invention is to provide a pillow structure that supports a user's head and neck exactly and has an adjustable height.

In accordance with the present invention, there is provided a pillow structure comprising a pillow, a buffering layer mounted in the pillow, a base plate mounted on a bottom of the buffering layer and received in the pillow, elastic cushions mounted on the base plate, and adjusting devices connected with the elastic cushions. Each of the adjusting devices includes a connecting wire. The elastic cushions are mounted on a bottom face of the base plate and are drawn by the adjusting devices. Each of the elastic cushions is connected with the connecting wire of each of the adjusting devices. Each of the elastic cushions has a fixed portion and has two ends. The two ends of each of the elastic cushions are connected and drawn by the connecting wire which is drawn by each of the adjusting devices, to change a curvature of each of the elastic cushions, such that the elastic cushions on the bottom face of the base plate support and adjust a height of the pillow, and the pillow has an optimum height to provide a comfortable sensation to a user when sleeping at a supine position and sleeping sideways.

According to the primary advantage of the present invention, the elastic cushions on the top face of the base plate are adjusted to push the buffering layer upward, such that the buffering layer protrudes outward from the pillow to an extent according to the user's requirement, so as to support the user's head and neck efficiently.

According to another advantage of the present invention, the elastic cushions on the bottom face of the base plate are adjusted to change the height of the pillow according to the user's requirement, such that the pillow has the optimum height to provide a comfortable sensation to the user when sleeping upwards or sleeping sideways.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
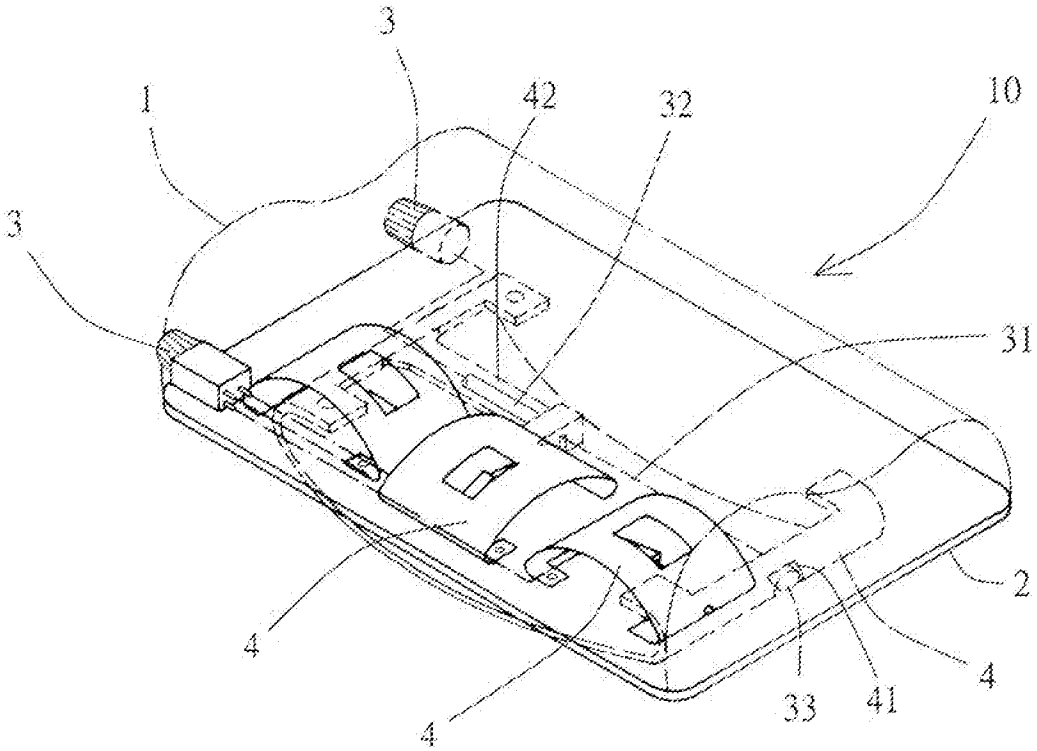
FIG. 1 is a perspective view of a pillow structure in accordance with the preferred embodiment of the present invention.

Referring to the drawings and initially to FIGS. 1-4, a pillow structure in accordance with the preferred embodiment of the present invention comprises a pillow 10, a buffering layer (or cushioning layer or lining layer) 1 mounted in the pillow 10, a base plate (or board) 2 mounted on a bottom of the buffering layer 1 and received in the pillow 10, elastic cushions 4 mounted on the base plate 2, and adjusting devices 3 connected with the elastic cushions 4.

Figure 2:
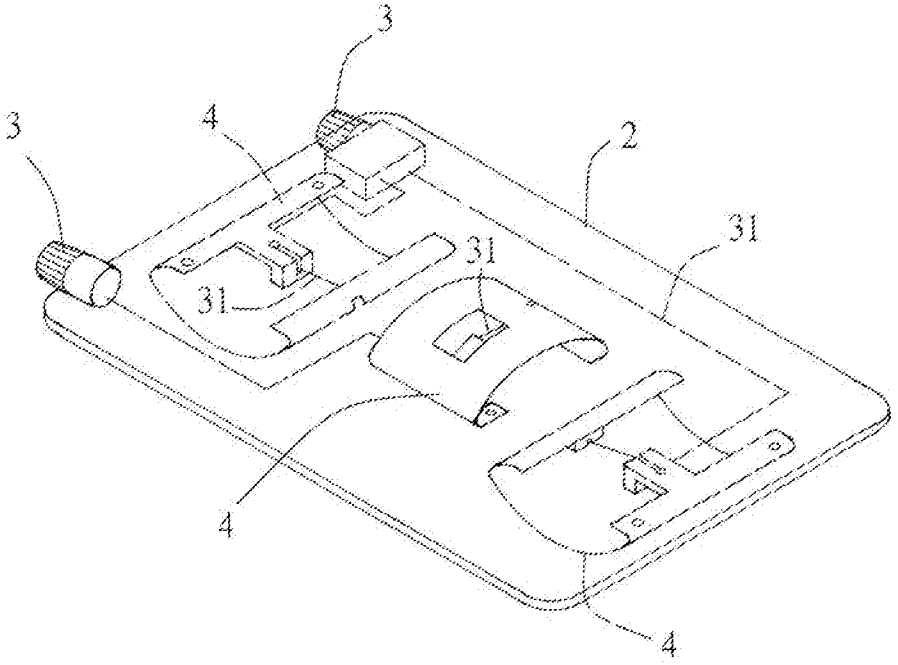
FIG. 2 is another perspective view of the pillow structure in accordance with the preferred embodiment of the present invention.
Figure 3:
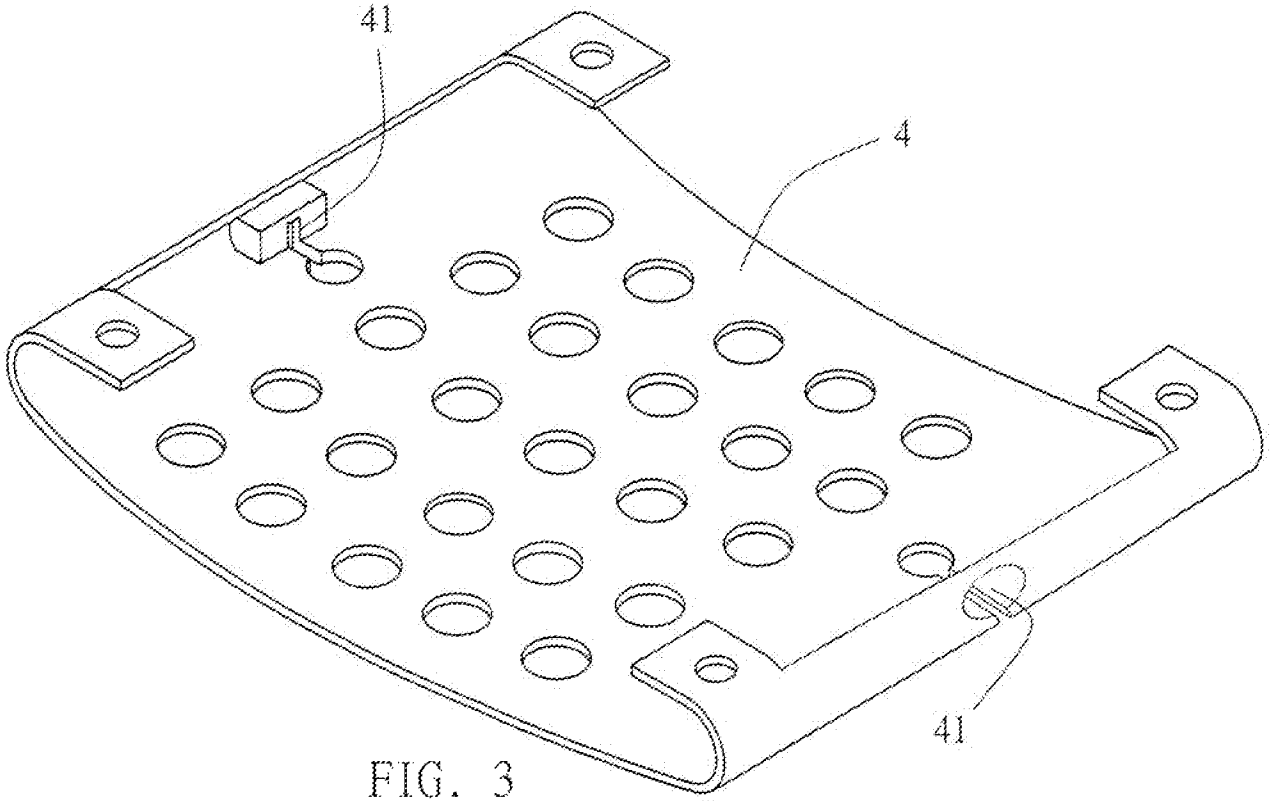
FIG. 3 is a perspective view of an elastic cushion of the pillow structure in accordance with the preferred embodiment of the present invention.
Figure 4:
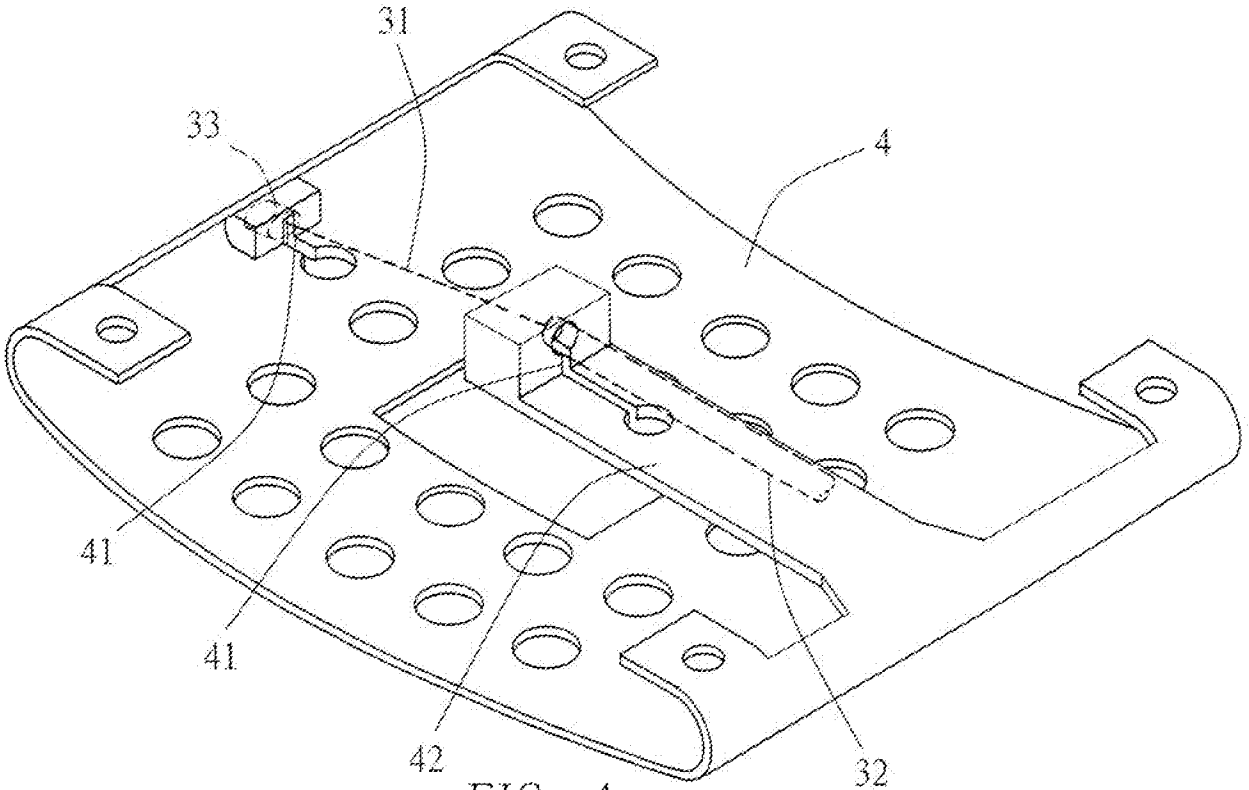
FIG. 4 is a perspective view of an elastic cushion of the pillow structure in accordance with another preferred embodiment of the present invention.

Each of the adjusting devices 3 includes a connecting wire (or cord) 31. The elastic cushions 4 are mounted on a bottom face of the base plate 2 and are drawn by the adjusting devices 3 as shown in FIG. 2. Each of the elastic cushions 4 is connected with the connecting wire 31 of each of the adjusting devices 3. Each of the elastic cushions 4 has a fixed portion and has two ends. The two ends of each of the elastic cushions 4 are connected and drawn by the connecting wire 31 which is drawn by each of the adjusting devices 3, to change a curvature of each of the elastic cushions 4, such that the elastic cushions 4 on the bottom face of the base plate 2 support and adjust a height of the pillow 10, and the pillow 10 has an optimum height to provide a comfortable sensation to a user when lying down, sleeping at a supine position (or sleeping upwards) and sleeping sideways.

In the preferred embodiment of the present invention, the elastic cushions 4 are mounted on a top face of the base plate 2 and drawn by the adjusting devices 3 as shown in FIG. 1. The elastic cushions 4 on the top face of the base plate 2 support the buffering layer 1 of the pillow 10, for rest of the user's head and neck.

In the preferred embodiment of the present invention, each of the adjusting devices 3 further includes a wire jacket (or sheath) 32 and a wire head 33, and each of the two ends of each of the elastic cushions 4 is provided with a locking slot 41 (see FIGS. 3 and 4) for locking the wire jacket 32 and the wire head 33 of each of the adjusting devices 3.

In the preferred embodiment of the present invention, the locking slot 41 of at least one of the two ends of each of the elastic cushions 4 is provided with an extension 42 (see FIG.

4), such that the two ends of each of the elastic cushions 4 have a short distance therebetween.

In the preferred embodiment of the present invention, the fixed portion of each of the elastic cushions 4 is located at one of the two ends of each of the elastic cushions 4 or located at a center (or middle) of each of the elastic cushions 4.

In the preferred embodiment of the present invention, the base plate 2 is made of hard material (such as wood) or resilient material.

In the preferred embodiment of the present invention, the pillow structure comprises more than one or multiple evenly distributed elastic cushions 4 mounted on the top face of the base plate 2, and more than one or multiple evenly distributed elastic cushions 4 mounted on the bottom face of the base plate 2.

In the preferred embodiment of the present invention, the concave of each of the elastic cushions 4 is directed toward the base plate 2. Alternatively, the concave of each of the elastic cushions 4 is directed downward.

In practice, after the fixed portion of each of the elastic cushions 4 is affixed, the connecting wire 31 is drawn by each of the adjusting devices 3 to change the length of the connecting wire 31, such that the curvature (or radian) of each of the elastic cushions 4 is changed. In such a manner, the curvature of each of the elastic cushions 4 is changed and adjusted by each of the adjusting devices 3. Thus, the elastic cushions 4 on the top face of the base plate 2 support and project the buffering layer 1 of the pillow 10, to bear the user's head and neck efficiently. At the same time, the elastic cushions 4 on the bottom face of the base plate 2 support and adjust the height of the pillow 10, such that the pillow 10 has the optimum height to provide a comfortable sensation to the user when sleeping upwards or sleeping sideways.

Figure 5:
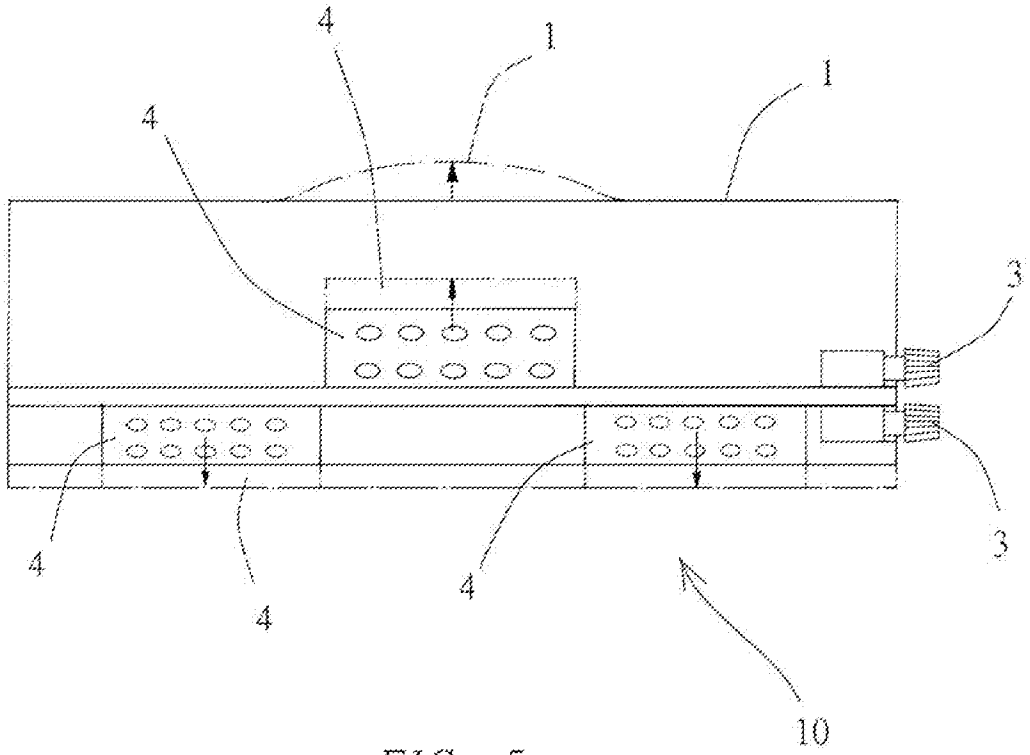
FIG. 5 is a schematic operational view of the pillow structure in accordance with the preferred embodiment of the present invention.
Figure 6:
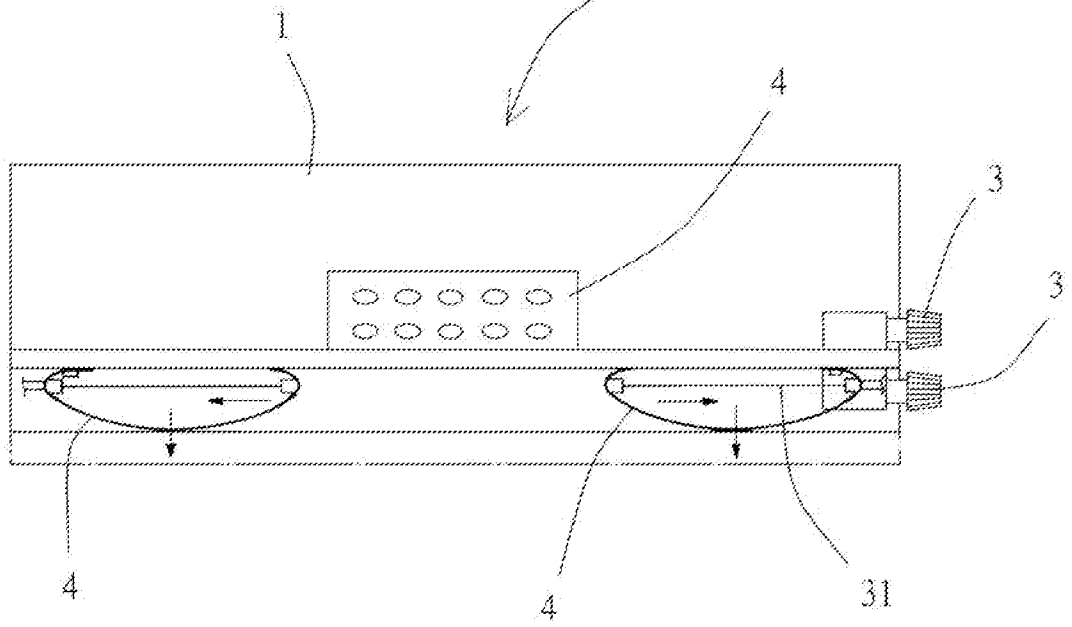
FIG. 6 is another schematic operational view of the pillow structure in accordance with the preferred embodiment of the present invention.

In operation, referring to FIGS. 5 and 6 with reference to FIGS. 1-4, the elastic cushions 4 are respectively mounted on the top face and the bottom face of the base plate 2 and are drawn by the adjusting devices 3. At this time, the connecting wire 31 is drawn by each of the adjusting devices 3 to change and adjust the curvature of each of the elastic cushions 4. In such a manner, the elastic cushions 4 on the top face of the base plate 2 are adjusted to support and push the buffering layer 1 upward, such that the buffering layer 1 protrudes outward from the pillow 10 as shown in FIG. 5, so as to bear the user's head and neck efficiently. Preferably, the projecting height of the buffering layer 1 is adjusted according to the user's requirement. On the other hand, the elastic cushions 4 on the bottom face of the base plate 2 are used to support the pillow 10 and are directed toward the bed mattress. When the elastic cushions 4 on the bottom face of the base plate 2 are drawn by the adjusting devices 3 to change the curvature of each of the elastic cushions 4, the height of the pillow 10 is changed as shown in FIG. 6. Preferably, when the elastic cushions 4 are arched, the height of the pillow 10 is increased, and when the curvature (or radian) of each of the elastic cushions 4 is decreased, the height of the pillow 10 is decreased. Thus, the elastic cushions 4 on the bottom face of the base plate 2 are adjusted to change the height of the pillow 10, such that the pillow 10 has the optimum height to provide a comfortable sensation to the user when sleeping upwards or sleeping sideways.

Figure 7:
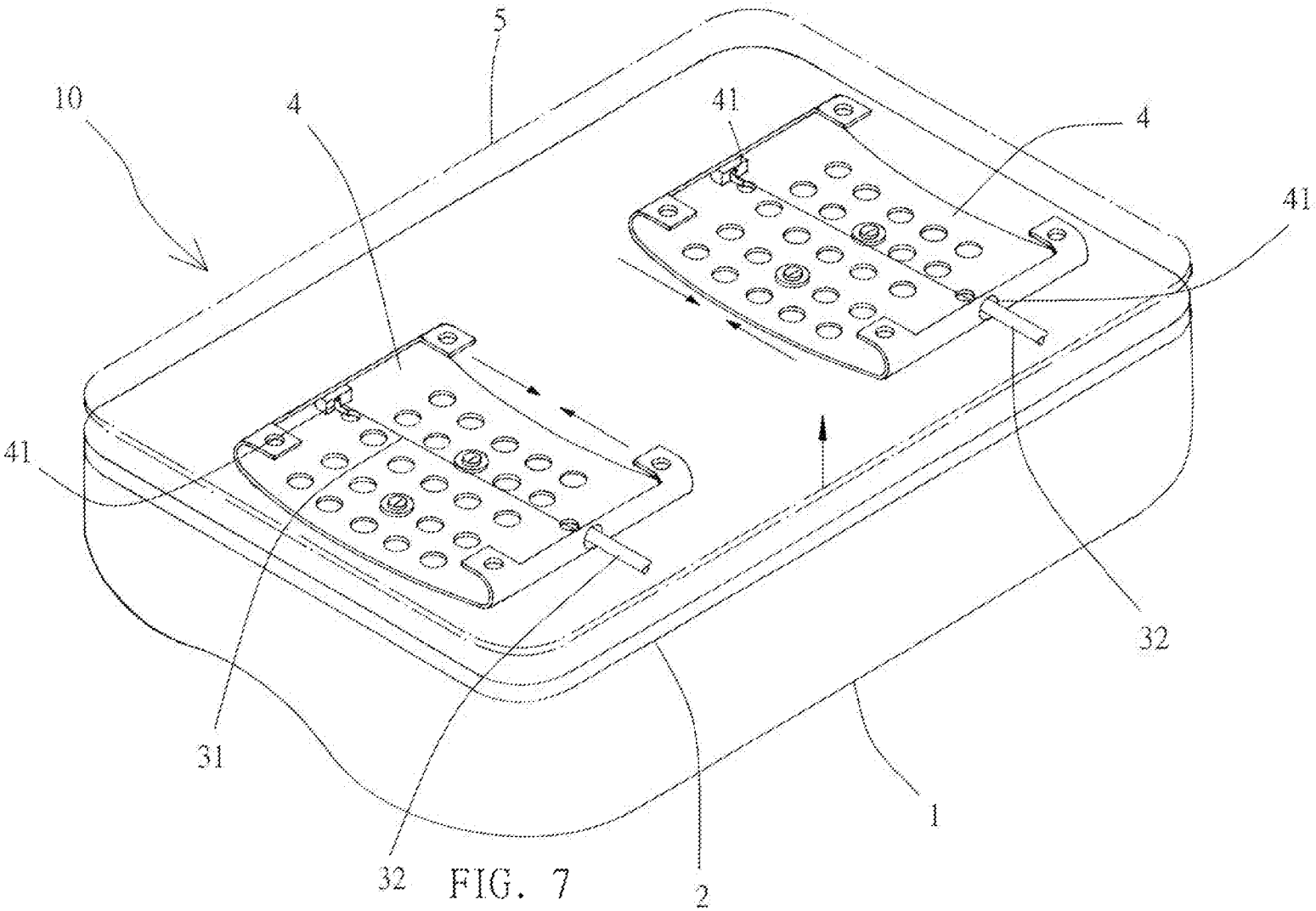
FIG. 7 is a perspective view of a pillow structure in accordance with another preferred embodiment of the present invention.

Referring to FIG. 7, the pillow structure further comprises a support board 5 mounted on the elastic cushions 4 on the bottom face of the base plate 2 for sliding contact and for withstanding the force, to prevent the elastic cushions 4 from directly sliding in the pillowcase.

Accordingly, the elastic cushions 4 on the top face of the base plate 2 are adjusted to push the buffering layer 1 upward, such that the buffering layer 1 protrudes outward from the pillow 10 to an extent according to the user's requirement, so as to support the user's head and neck efficiently. In addition, the elastic cushions 4 on the bottom face of the base plate 2 are adjusted to change the height of the pillow 10 according to the user's requirement, such that the pillow 10 has the optimum height to provide a comfortable sensation to the user when sleeping upwards or sleeping sideways.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A pillow structure comprising:

a pillow;

a buffering layer mounted in the pillow;

a base plate mounted on a bottom of the buffering layer and received in the pillow;

elastic cushions mounted on the base plate; and adjusting devices connected with the elastic cushions;

wherein:

each of the adjusting devices includes a connecting wire;

the elastic cushions are mounted on a bottom face of the base plate and are drawn by the adjusting devices;

each of the elastic cushions is connected with the connecting wire of each of the adjusting devices;

each of the elastic cushions has a fixed portion and has two ends;

the two ends of each of the elastic cushions are connected and drawn by the connecting wire which is drawn by each of the adjusting devices, to change a curvature of each of the elastic cushions, such that the elastic cushions on the bottom face of the base plate support and adjust a height of the pillow, and the pillow has an optimum height to provide a comfortable sensation to a user when sleeping at a supine position and sleeping sideways.

2. The pillow structure as claimed in claim 1, wherein: additional elastic cushions are mounted on a top face of the base plate and drawn by the adjusting devices; and the elastic cushions on the top face of the base plate support the buffering layer of the pillow, for rest of the user's head and neck.

3. The pillow structure as claimed in claim 1, further comprising:

a support board mounted on the elastic cushions on the bottom face of the base plate for a sliding contact and for withstanding a force.

4. The pillow structure as claimed in claim 1, wherein each of the adjusting devices further includes a wire jacket and a wire head, and each of the two ends of each of the elastic cushions is provided with a locking slot for locking the wire jacket and the wire head of each of the adjusting devices.

5. The pillow structure as claimed in claim 4, wherein the locking slot of at least one of the two ends of each of the elastic cushions is provided with an extension.

6. The pillow structure as claimed in claim 1, wherein the fixed portion of each of the elastic cushions is located at one of the two ends of each of the elastic cushions or located at a center of each of the elastic cushions.

* * * * *